US010976040B2

(12) United States Patent
Wang et al.

(10) Patent No.: US 10,976,040 B2
(45) **Date of Patent: *Apr. 13, 2021**

(54) ADAPTOR, LIGHT SOURCE DEVICE, AND LIGHTING APPARATUS

(71) Applicant: OPPLE LIGHTING CO., LTD., Shanghai (CN)

(72) Inventors: Keyong Wang, Shanghai (CN); Chengpei You, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 172 days.

This patent is subject to a terminal disclaimer.

(21) Appl. No.: 16/196,122

(22) Filed: Nov. 20, 2018

(65) Prior Publication Data

US 2019/0086068 A1 Mar. 21, 2019

Related U.S. Application Data

(63) Continuation of application No. PCT/CN2017/084369, filed on May 17, 2017.

(30) Foreign Application Priority Data

May 20, 2016 (CN) ..... 201610339970.3
May 20, 2016 (CN) ..... 201620472128.2

(51) Int. Cl.

| | |
|---|---|
| ***F21V 23/06*** | (2006.01) |
| ***H01R 31/06*** | (2006.01) |
| ***H01R 33/955*** | (2006.01) |
| *H01R 13/629* | (2006.01) |

(Continued)

(52) U.S. Cl.

CPC ..... *F21V 23/06* (2013.01); *H01R 31/065* (2013.01); *H01R 33/955* (2013.01); *F21K 9/238* (2016.08);

(Continued)

(58) Field of Classification Search

CPC .. H01R 33/942; H01R 31/065; H01R 33/955; F21V 23/001; F21V 23/006; F21V 25/04;

(Continued)

(56) References Cited

U.S. PATENT DOCUMENTS

| | | | | |
|---|---|---|---|---|
| 9,923,325 | B2 * | 3/2018 | Jansen | F21K 9/272 |
| 2012/0106157 | A1 * | 5/2012 | Simon | F21V 25/04 362/249.05 |

(Continued)

FOREIGN PATENT DOCUMENTS

| | | | |
|---|---|---|---|
| CN | 102570228 | A | 7/2012 |
| CN | 105958286 | A | 9/2016 |

(Continued)

OTHER PUBLICATIONS

International Search Report and Written Opinion (including English translations) issued in PCT/CN2017/084369, dated Aug. 3, 2017, 13 pages.

*Primary Examiner* — Tho D Ta
(74) *Attorney, Agent, or Firm* — Arch & Lake LLP

(57) ABSTRACT

An adaptor, a light source device using the adaptor, and a lighting apparatus using the adaptor are provided. The adaptor includes a main body, a protruding part, and an operating component. The main body includes: a power supply mounting part, a light source mounting part, and a conducting circuit extending from the power supply mounting part to the light source mounting part; the protruding part is operatively movable to a blocking position for blocking the power supply mounting part from being engaged with the power supply module, and a releasing position for releasing the power supply mounting part to be engaged with the power supply module. The operating component is operatively movable on the main body to an on-position and an off-position.

17 Claims, 7 Drawing Sheets

(51) Int. Cl.

| | |
|---|---|
| *F21V 19/00* | (2006.01) |
| *H01R 33/05* | (2006.01) |
| *F21V 25/04* | (2006.01) |
| *F21V 23/00* | (2015.01) |
| *F21K 9/238* | (2016.01) |
| *H01R 33/94* | (2006.01) |

(52) U.S. Cl.
CPC ..... *F21V 19/008* (2013.01); *F21V 23/001* (2013.01); *F21V 23/006* (2013.01); *F21V 25/04* (2013.01); *H01R 13/629* (2013.01); *H01R 33/05* (2013.01); *H01R 33/942* (2013.01)

(58) Field of Classification Search
CPC ..... F21V 23/06; F21V 19/008; F25V 25/04; F21K 9/272; F21K 9/275; F21K 9/238
See application file for complete search history.

(56) References Cited

U.S. PATENT DOCUMENTS

| | | | | |
|---|---|---|---|---|
| 2012/0155074 | A1* | 6/2012 | Mori ..... | H01R 33/06 362/221 |
| 2014/0355261 | A1* | 12/2014 | Dingemans ..... | F21K 9/272 362/217.17 |
| 2019/0086067 | A1* | 3/2019 | Feng ..... | F21V 25/04 |

FOREIGN PATENT DOCUMENTS

| | | | |
|---|---|---|---|
| CN | 205790829 | U | 12/2016 |
| EP | 0677699 | A1 | 10/1995 |

* cited by examiner

ADAPTOR, LIGHT SOURCE DEVICE, AND LIGHTING APPARATUS

CROSS-REFERENCE TO RELATED APPLICATIONS

This application is based upon and claims the priority of PCT patent application No. PCT/CN2017/084369 filed on May 15, 2017 which claims the priority of Chinese Patent Application No. 201610339970.3 filed on May 20, 2016 and Chinese Patent Application No. 201620472128.2 filed on May 20, 2016, the entire contents of which are hereby incorporated by reference herein.

TECHNICAL FIELD

Examples of the present disclosure relate to the field of lighting technology, and particularly to an adaptor, a light source device and a lighting apparatus.

BACKGROUND

At present, a lighting apparatus usually emits irradiation light towards an irradiated object by an electrically driven lighting module so as to achieve illuminating the irradiated object. With the rapid development of the lighting technology, the lighting apparatus is becoming more and more popular, and how to improve a safety of the lighting apparatus has received attentions in the industry.

An existing lighting apparatus generally includes a light-emitting apparatus for emitting irradiation light, a power supply module for supplying an electric power, and an adaptor for engaging the light-emitting apparatus with the power supply module. The adaptor typically includes: a conducting circuit for connecting to the light-emitting apparatus, and a conducting terminal which is electrically connected to the conducting circuit and is used for engaging with the power supply module. After the light-emitting apparatus, the adaptor and the power supply module are connected, the electric power outputted by the power supply module passes through the conducting terminal and the conducting circuit in sequence, and then arrives at the light-emitting apparatus to allow the light-emitting apparatus to emit the irradiation light.

However, the existing lighting apparatus is not provided with any safety protection device. A user can directly electrically connect the conducting terminal with the power supply module to activate the lighting apparatus. When the conducting terminal is electrically connected with the power supply module due to a misoperation of the user, the user is likely to be subjected to an electric shock, leading to a severe safety risk in the existing lighting apparatus.

SUMMARY

An objective of the examples of the present disclosure is to provide an adaptor, a light source device and a lighting apparatus, for solving the problem that the existing lighting apparatus involves a safety risk.

In a first aspect, the present disclosure provides an adaptor for electrically connecting a power supply module with a light-emitting apparatus. The adaptor includes a main body, including: an outer wall, forming an inner chamber, a power supply mounting part, located at the outer wall and configured to be engaged with the power supply module; a light source mounting part, located at the outer wall and disposed opposite to the power supply mounting part, and configured to be engaged with the light-emitting apparatus; a conducting circuit, located in the inner chamber and configured to be capable of turned on/off, and configured to transmit electric power outputted by the power supply module to the light-emitting apparatus, when the power supply mounting part is engaged with the power supply module and the light source mounting part is engaged with the light-emitting apparatus, a protruding part, movably connected to the main body, wherein the protruding part is operatively movable to a blocking position and a releasing position; when in the blocking position, the protruding part blocks the power supply mounting part from being engaged with the power supply module, and when in the releasing position, the protruding part releases the power supply mounting part to be engaged with the power supply module, and an operating component, movably connected to the main body and the protruding part, wherein the operating component is operatively movable on the main body to an on-position and an off-position; when the power supply mounting part is engaged with the power supply module, by a resisting force from the power supply module, the protruding part moves to the releasing position and maintains in the releasing position, and the operating component moves to the on-position to turn on the conducting circuit; when the power supply mounting part is separated from the power supply module, the protruding part moves to the blocking position from the releasing position and meanwhile driving the operating component to move from the on-position to the off-position to turn off the conducting circuit.

In a second aspect, the present disclosure provides a lighting apparatus, including: a light-emitting apparatus; a power supply module; and the adaptor as described above. The light source mounting part in the adaptor is engaged with the light-emitting apparatus, and the power supply mounting part in the adaptor is engaged with the power supply module, so that both of the light-emitting apparatus and the power supply module are electrically connected to the conducting circuit.

The above description is only an overview of the technical solutions of the present disclosure. In order to make the technical solutions of the present disclosure more clearly understandable so as to be implemented in accordance with the contents of the specification, and in order to make the above-described and other objects, features and advantages of the present disclosure more apparent, specific examples of the present disclosure are set forth below.

BRIEF DESCRIPTION OF THE DRAWINGS

Hereinafter, drawings accompanying example(s) or necessary for description of the existing technology are briefly introduced in order to more definitely explain the example(s) of the present disclosure or technical solution(s) of the existing technology. Apparently, the drawings described below are merely some examples recorded in the present disclosure, from which other drawing(s) may be derived by those ordinary skilled in the art, without any inventive work.

DETAILED DESCRIPTION

Examples of the present disclosure provide an adaptor, a light source device and a lighting apparatus, for solving the problem that the lighting apparatus in the existing technology may involve a safety risk.

In order to make technical solution(s) of the example(s) of the present disclosure more understandable for those skilled in the art, hereinafter the technical solution(s) of the example (s) will be described clearly and completely in connection with the drawings of the examples of the present disclosure. Apparently, the described examples are just a part but not all of the examples of the present disclosure. Based on the examples of the present disclosure, those ordinary skilled in the art can obtain other example(s), without any inventive work, which should be within the scope of the disclosure.

Figure 1:
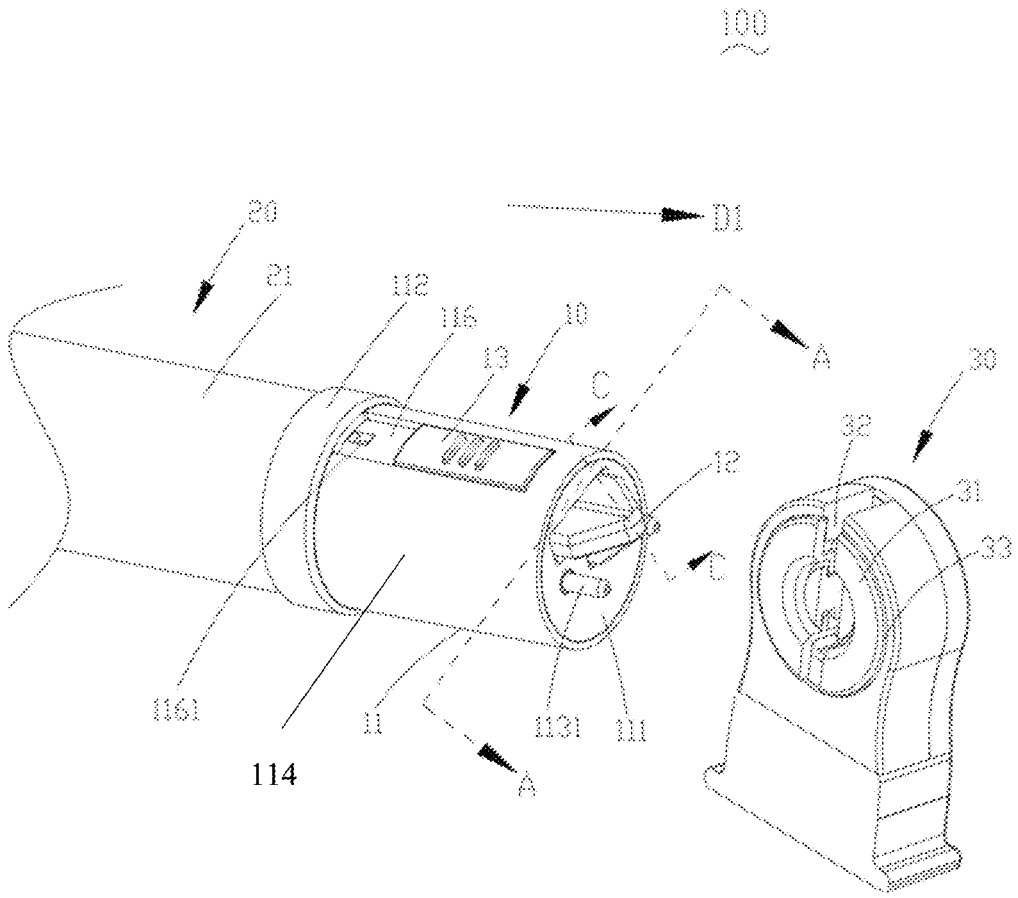
FIG. 1 is a partially exploded view of a lighting apparatus in an example of the present disclosure, in which an adaptor is engaged with a light-emitting apparatus but is separated from a power supply module, an operating component is in an off-position, and a protruding part is in a blocking position.
Figure 2:
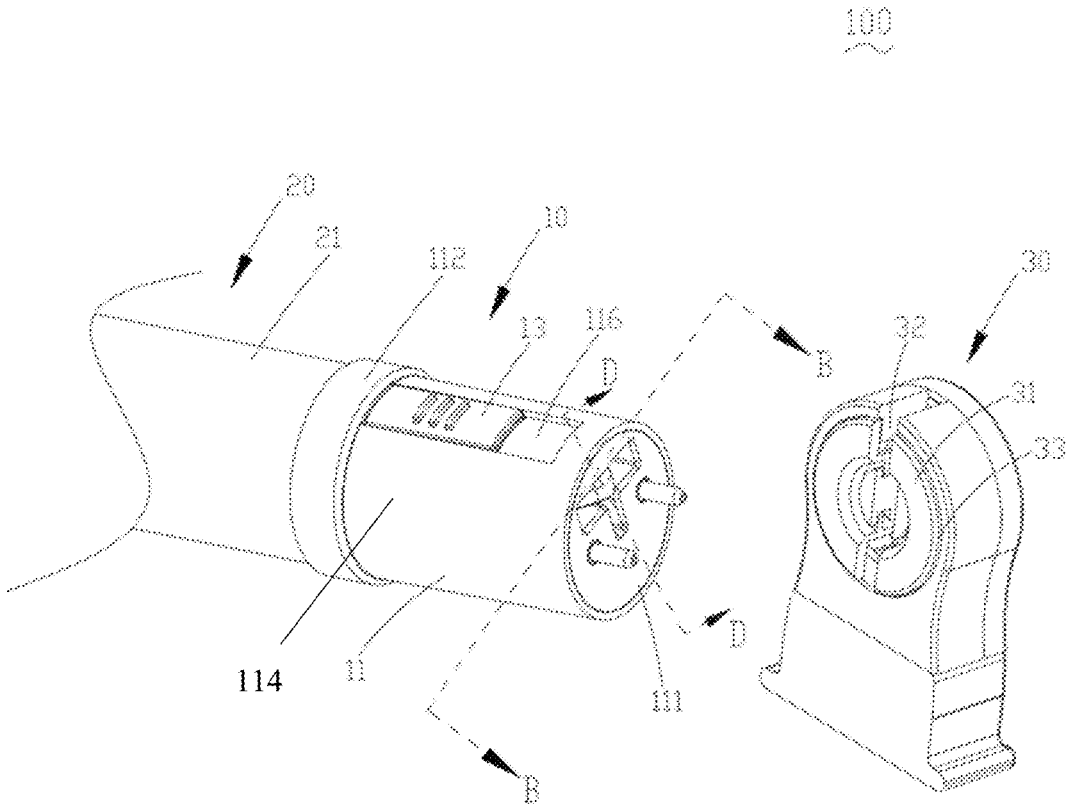
FIG. 2 is a partially exploded view of a lighting apparatus in an example of the present disclosure, in which an adaptor is engaged with a light-emitting apparatus but is separated from a power supply module, an operating component is in an on-position, and a protruding part is in a releasing position.
Figure 3:
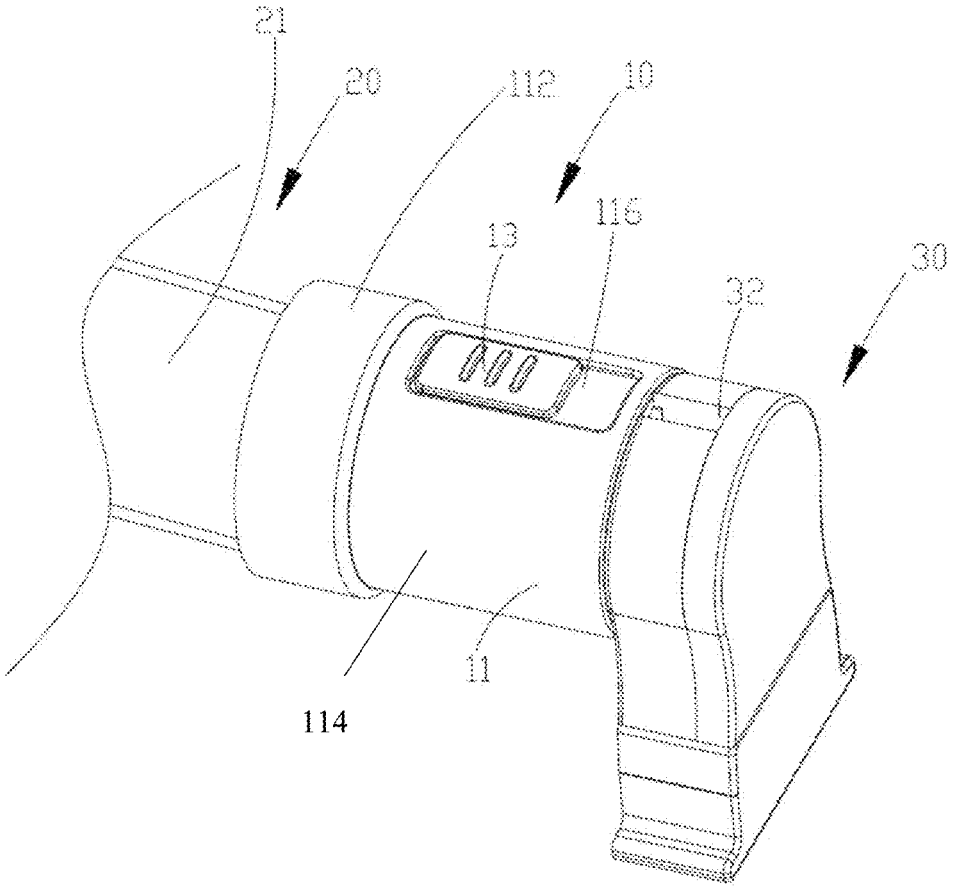
FIG. 3 is a perspective assembling view of a lighting apparatus in an example of the present disclosure, in which an adaptor is engaged with both of a light-emitting apparatus and a power supply module.

Referring to FIGS. 1-3, a lighting apparatus 100 includes an adaptor 10, a light-emitting apparatus 20 and a power supply module 30. The light-emitting apparatus 20 and the adaptor 10 can be combined into a light source device, for example, the integrally provided light-emitting apparatus 20 and adaptor 10 can be used as an independently sold and utilized light source device; when there is a lighting requirement, a user can directly engage the light source device with the power supply module 30, or engage the light-emitting apparatus 20 with the adaptor 10 and then engage the adaptor 10 with the power supply module 30, so that the power supply module 30 can supply an electric power to the light-emitting apparatus 20 through the adaptor 10, thereby achieving emitting irradiation light towards an irradiated object by the light-emitting apparatus 20 so as to illuminate the irradiated object.

The light-emitting apparatus 20 includes an optical element 21, a light-emitting source (not illustrated) and a driving component (not illustrated) for regulating a driving current supplied to the light-emitting source. The light-emitting source is electrically connected to the driving component, and can be electrically connected to the adaptor 10 later.

The light-emitting source may be of a plurality of types such as LED light source and TL light source; the driving component can be embodied in a form of printed circuit board (PCB); the optical element 21 covers the light-emitting source and the driving component, for protecting the light-emitting source and the driving component from external damage and achieving refracting the irradiation light emitted from the light-emitting source onto object; the optical element 21 can adopt a form of a lens through which the irradiation light emitted from the light-emitting source travels, and can also adopt a form of light-mixing cover which can uniformly adjust the irradiation light emitted from the light-emitting source. Whether in a form of lens or a form of light-mixing cover, a shape of the optical element 21 can be preset according to the lighting environment. For example, the optical element 21 can be configured as a long straight light tube. The number of the optical element 21 can be identical or inconsistent with the number of the light-emitting source(s). For example, one light-emitting source is provided with one optical element 21, or a plurality of light-emitting sources can be provided with one optical element 21.

The power supply module 30 can adopt a DC power supply or an AC power supply. The power supply module 30 can be fixed to a region such as a wall, a ceiling, a floor, or the like; correspondingly, the lighting apparatus 100 can be a ceiling lamp, a wall lamp, a lamp tube or the like. The power supply module 30 can also be configured to be movable, then the lighting apparatus 100 can be a movable desk lamp, a movable floor lamp or the like.

In an example of the present disclosure, the power supply module 30 includes an annular retaining wall 31, as well as a recess 32 accommodating the protruding part 12, and a terminal connecting part 33 which is covered by the annular retaining wall 31. The retaining wall 31 is rotatable on the power supply module 30, so as to expose and cover the recess 32 and the terminal connecting part 33. During the movement of the annular retaining wall 31, the annular retaining wall 31 can move to a position where the recess 32 is exposed but the terminal connecting part 33 is covered, and can also move to a position where the recess 32 is covered but the terminal connecting part 33 is exposed.

The annular retaining wall 31 can be made of an electrically insulating material, for preventing the user from touching the terminal connecting part 33 by mistaken and resulting in an electric shock accident. The terminal connecting part 33 can be configured as two separated semi-circular portions which are used as a positive electrode and a negative electrode of the power supply module 30, respectively.

In an example of the present disclosure, the adaptor 10 includes a main body 11, a protruding part 12 and an operating component 13; the main body 11 can be made of a hard material such as plastic and metal, as long as it ensures a structural stability of the main body 11. The protruding part 12 may also be referred as a push-out part that is protruded from the surface of the main body 11.

Figure 4:
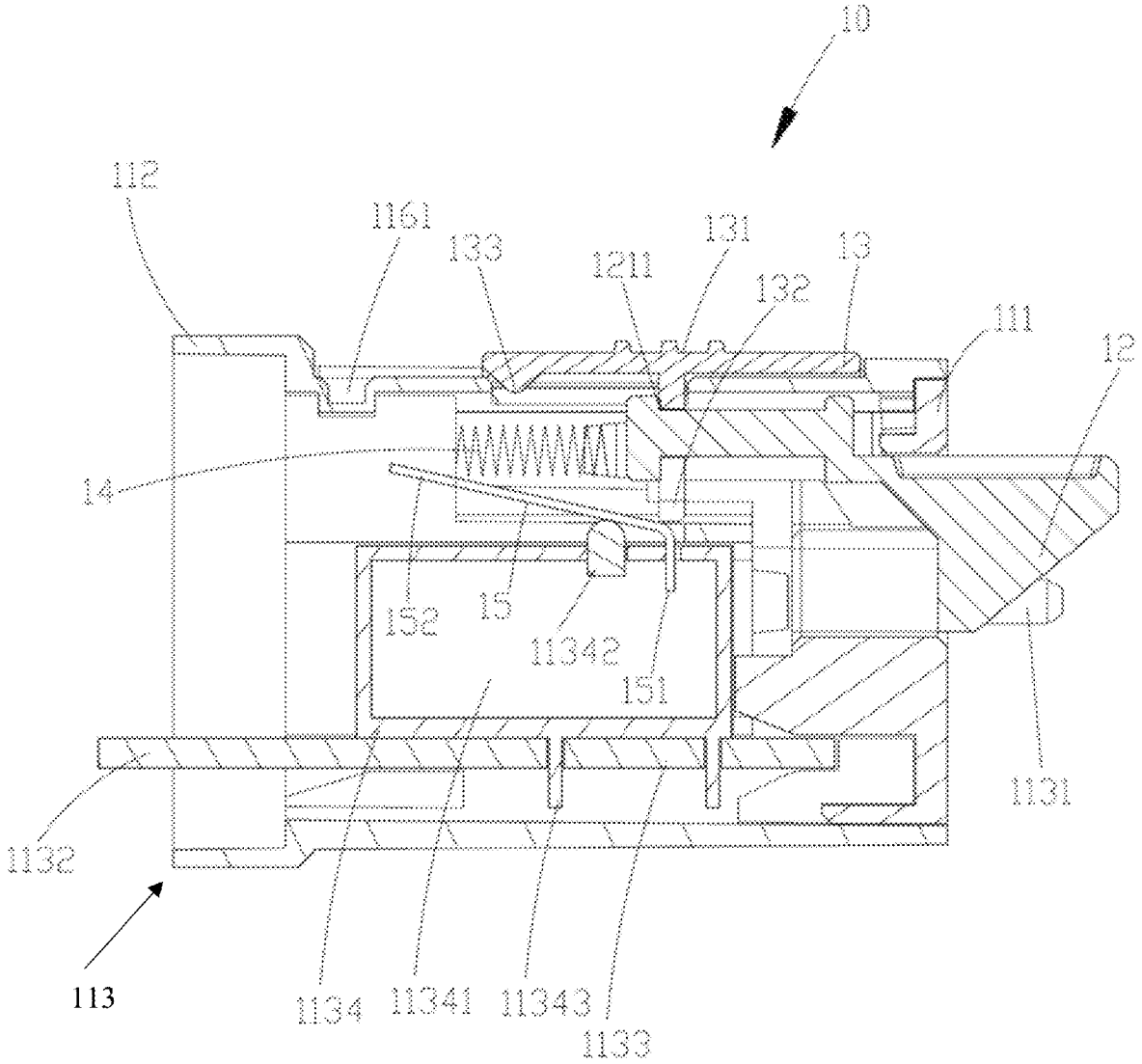
FIG. 4 is a cross-sectional view taken along C-C direction of an adaptor in the lighting apparatus illustrated in FIG. 1.
Figure 5:
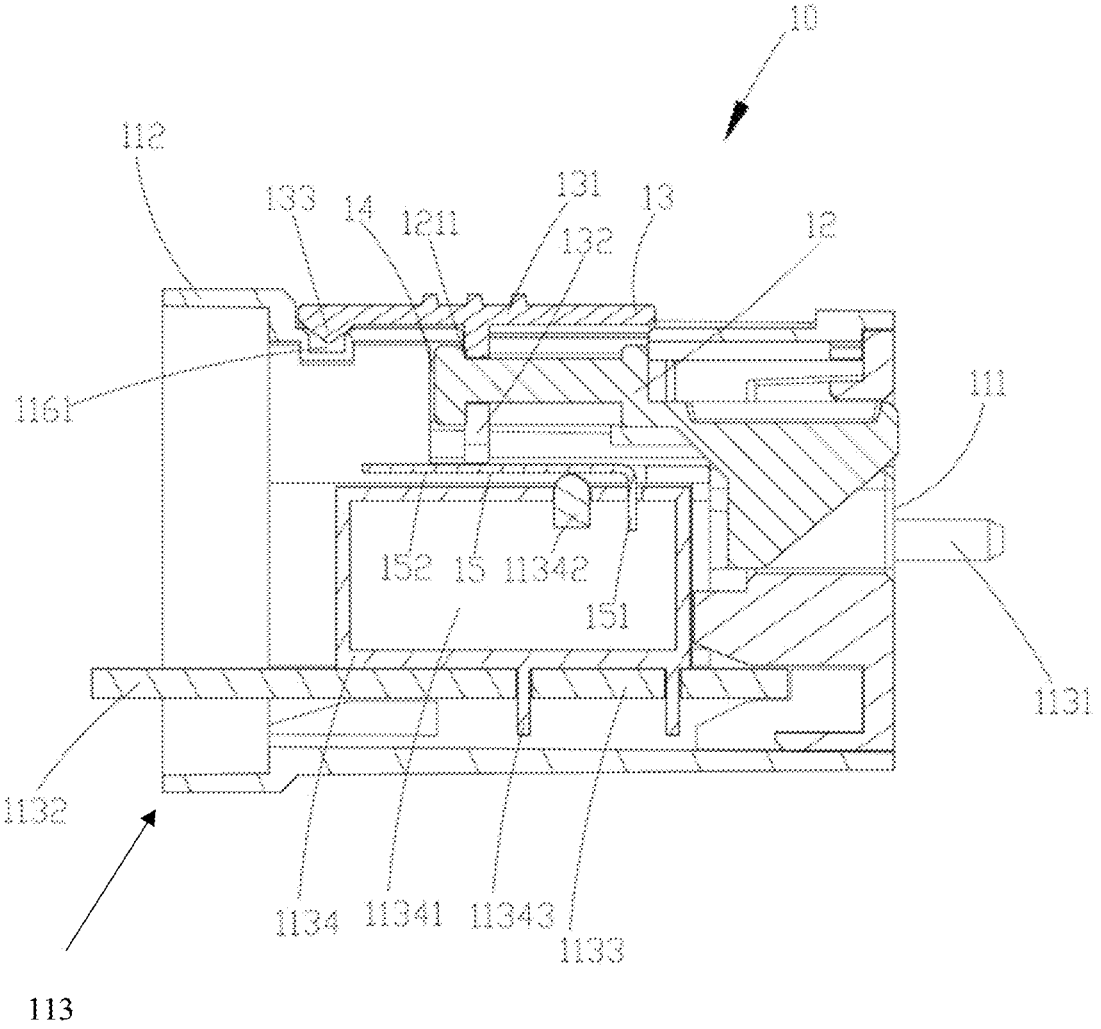
FIG. 5 is a cross-sectional view taken along D-D direction of an adaptor in the lighting apparatus illustrated in FIG. 2.

With reference to FIGS. 4 and 5, the main body 11 includes a power supply mounting part 111, a light source mounting part 112 and a conducting circuit 113; relative positions of the power supply mounting part 111 and the light source mounting part 112 can be set according to a position of the adaptor 10 in the lighting apparatus 100. For example, the power supply mounting part 111 and the light source mounting part 112 can be disposed in parallel, disposed oppositely, disposed perpendicular or the like. The power supply mounting part 111 is to be engaged with the power supply module 30; the power supply module 30 and the power supply mounting part 111 can be fixed with respect to each other by various ways such as snap-fitting, screw thread and screw; the light source mounting part 112 is configured to engage with the light-emitting apparatus 20; the light-emitting apparatus 20 and the light source mounting part 112 can also be fixed with respect to each other by various ways such as snap-fitting, screw thread and screw.

In an example of the present disclosure, the main body 11 has a longitudinal lengthwise direction D1; the main body 11 can be configured as a long straight cylinder which extends along the direction D1; the power supply mounting part 111 and the light source mounting part 112 can be placed at opposite two ends of the main body 11 in a form of long straight cylinder along the direction D1, respectively.

Still in the example above, the power supply mounting part 111 can be configured to have a convex end face shape; correspondingly, a region on the power supply module 30 to be engaged with the power supply mounting part 111 is configured to have an opening shape; the power supply mounting part 111 can be firstly inserted into the region having a shape of opening in the power supply module 30 and then firmly connected with the power supply module 30 by a fixing method such as snap-fitting and screw thread as mentioned above. In the example of the present disclosure, by adjusting a shape of the power supply mounting part 111, the power supply mounting part 111 is engaged with the power supply module 30 along the longitudinal lengthwise direction D1 of the main body 11.

Still in the example above, the light source mounting part 112 can be configured to have a concave opening shape; the light-emitting apparatus 20 can be firstly inserted into the light source mounting part 112 in a shape of opening and then firmly connected with the light source mounting part 112 by a fixing method such as snap-fitting and screw as mentioned above, or the light-emitting apparatus 20 and the main body 11 can be integrally provided, directly.

The conducting circuit 113 located inside the main body 11 a first conducting terminal 1131 which extends into the power supply mounting part 111 and is configured for electrically connecting to the power supply module 30; a second conducting terminal 1132 which extends into the light source mounting part 112 and is configured for electrically connecting to the light-emitting apparatus 20; a control module 1133 connecting the first conducting terminal 1131 and the second conducting terminal 1132 in series; and an on-off switch 1134 connected to the conducting circuit 113 in series. An on-state and an off-state of the conducting circuit 113 can directly affect whether an electric connection between the first conducting terminal 1131 and the second conducting terminal 1132 is turned on or turned off.

In an example of the preset disclosure, the control module 1133 can adopt a form of integrated circuit board, and can include conventional functional modules such as current detection module, voltage detection module and control chip; the control chip can integrate a plurality of protection functions and a driving function of the light-emitting apparatus 20. For example, an electric current in the conducting circuit 113 can be obtained from the current detection module by the control chip; when the current is excessively large, turning off the conducting circuit 113 to achieve an overcurrent protection of the light-emitting apparatus 20. For example, a voltage applied on the first conducting terminal 1131 can be obtained from the voltage detection module by the control chip; when the voltage is excessively small, turning off the conducting circuit 113 to achieve an over-discharge protection of the power supply module 30 in the case where a DC battery pack is used as the power supply module 30. For example, a current value of the conducting circuit 113 can be regulated by the control chip, so that the light-emitting apparatus 20 can be operated at a rated operational current. In a practical application, the control module 1133 can achieve turning on and off the conducting circuit 113 by adjusting an on-state and an off-state of the on-off switch 1134.

In an example of the preset disclosure, the second conducting terminal 1132 can be directly disposed at an end of the control module 1133 located inside the light source mounting part 112; the light-emitting apparatus 20 has an engaging interface (not illustrated) which is electrically connected to both of the light-emitting source and the driving component in the light-emitting apparatus 20; when the light-emitting apparatus 20 is mounted to the light source mounting part 112, the engaging interface of the light-emitting apparatus 20 is electrically connected to the second conducting terminal 1132. In a practical application, the engaging interface and the second conducting terminal 1132 can adopt various forms such as abutting electrode pieces, contacting dots, engaging chute and long straight metallic rod, without particularly described herein.

The on-off switch 1134 can include: a switch base 11341 connected to the conducting circuit 113 in series, and a switch button 11342 connected to the switch base 11341. Specifically, the switch base 11341 is connected to the integrated circuit board on which the control module 1133 is located through two independent pins 11343, so that the switch base 11341 and the control module 1133 are connected in series. The switch button 11342 can be pressed towards the switch base 11341 to turn on the switch base 11341; when the switch button 11342 is no longer pressed, it moves away from the switch base 11341 and returns to its original position, so as to turn off the switch base 11341, thereby achieving turning on and turning off the conducting circuit 113 by operating the on-off switch 1134. In a practical application, the switch base 11341 is a base of a commonly used micro switch, and then the switch button 11342 can be a trigger button of the micro switch.

Of course, in a practical application, when the adaptor 10 has a relatively great size and results in a relatively large distance among the first conducting terminal 1131, the second conducting terminal 1132, the control module 1133 and the on-off switch 1134, the conducting circuit 113 can further include a conducting wire (not labeled) which connects the first conducting terminal 1131, the second conducting terminal 1132, the control module 1133 and the on-off switch 1134 in series; the conducting wire can be made of a conventional enameled copper wire or enameled wire, and can also be made of a hard metallic conductor, as long as it satisfies a basic requirement of achieving current transfer. The conducting wire can be electrically connected to the first conducting terminal 1131, the second conducting terminal 1132, the control module 1133 and the on-off switch 1134 by a fixed connection method such as welding, press-fitting and insulating displacement contacting, or by an adaptor interface such as FFC and FPC.

When the power supply module 30 is engaged with the power supply mounting part 111 and when the light-emitting apparatus 20 is engaged with or integrally provided with the light source mounting part 112, the power supply module 30 is electrically connected to the first conducting terminal 1131 in the conducting circuit 113, the light-emitting apparatus 20 is electrically connected to the second conducting terminal 1132 in the conducting circuit 113, so as to achieve transferring the electric power outputted by the power supply module 30 to the light-emitting apparatus 20.

Figure 6:
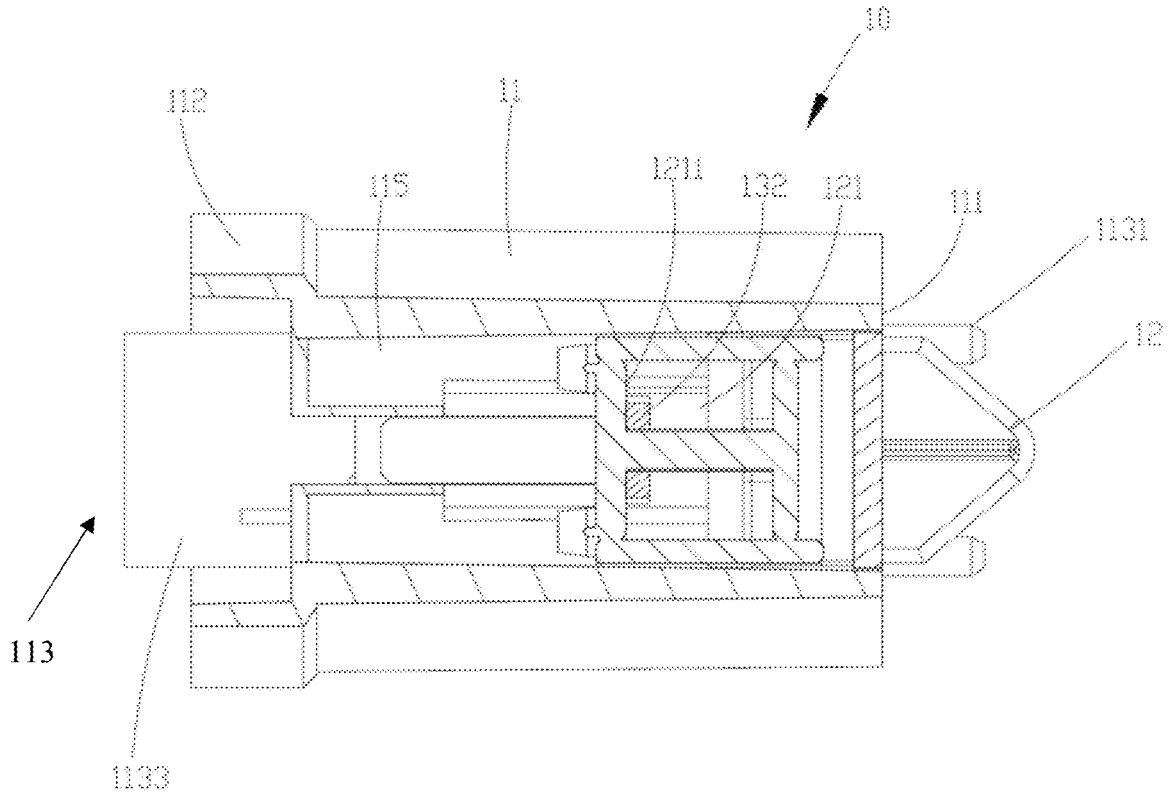
FIG. 6 is a cross-sectional view taken along A-A direction of an adaptor in the lighting apparatus illustrated in FIG. 1.

As illustrated in FIGS. 5 and 6, the protruding part 12 is movably connected with the main body 11, and is configured for safety protection during a mounting process of the main body 11 and the power supply module 30, so as to satisfy a safety standard requirement. In an example of the present disclosure, the protruding part 12 includes a first portion and a second portion both extending along the longitudinal lengthwise direction D1 of the main body. The first portion and the second portion are perpendicularly connected so that a cross section of the protruding part 12 taken along a direction perpendicular to the longitudinal lengthwise direction D1 has a shape close to T shape.

The protruding part 12 can be operatively moved to a blocking position and a releasing position. When the protruding part 12 is in the blocking position, the protruding part 12 blocks the power supply mounting part 111 from being engaged with the power supply module 30; when the protruding part 12 is in the releasing position, the protruding part 12 releases the power supply mounting part 111 to engage with the power supply module 30.

It should be noted that, "the power supply mounting part 111 is engaged with the power supply module 30" described herein is used for specifying the case where the power supply mounting part 111 is mechanically connected with the power supply module 30 and the conducting circuit 113 is electrically connected with the power supply module 30, but not including the case where the power supply mounting part 111 is mechanically connected with the power supply module 30 but the conducting circuit 113 is not electrically connected with the power supply module 30.

For example, the light-emitting apparatus 20 and the adaptor 10 can be integrally provided to form an independently usable light source device. Due to the presence of the protruding part 12, when it has no need of mounting the light source device to the power supply module 30, a user can move the protruding part 12 to the blocking position so that the adaptor 10 has no way of being engaged with the power supply module 30, which prevents the user from engaging the adaptor 10 in the light source device with the power supply module 30 without any protection measure by mistaken and resulting in an electric shock of the user, thereby ensuring the safety of the user and allowing the lighting apparatus 100 to meet the safety standard requirement. Conversely, when it needs to mount the light source device to the power supply module 30, the user can move the protruding part 12 to the releasing position so that the adaptor 10 can be engaged with the power supply module 30, which allows the lighting apparatus 100 to be normally operated.

In a practical application, the protruding part 12 can extend along the longitudinal lengthwise direction D1 of the main body 11 and is movable along this direction. When the power supply mounting part 111 is engaged with the power supply module 30, the protruding part 12 originally in the blocking position can be moved towards the releasing position by the power supply module 30, so as to allow the first conducting terminal 1131 to be electrically connected to the terminal connecting part 33 in the power supply module 30, and to allow the user to accomplish both of adjusting a position of the protruding part 12 and subsequently engaging the power supply module 30 with the adaptor 10 by one single step, thereby improving the user experience.

Before the power supply mounting part 111 is engaged with the power supply module 30, an annular retaining wall 31 in the power supply module 30 is moved to a position where a recess 32 is exposed and a terminal connecting part 33 is covered. When the power supply mounting part 111 is mounted to the power supply module 30, the protruding part 12 in the blocking position enters the recess 32, and the first conducting terminal 1131 cannot engage with the terminal connecting part 33 because the terminal connecting part 33 is covered by the annular retaining wall 31, thus it needs to rotate the adaptor 10 around the longitudinal lengthwise direction D1 thereof inside the power supply module 30. Because an end of the protruding part 12 is provided with a guiding slope, the protruding part 12 is moved towards the releasing position with the guide of the guiding slope and leaves the recess 32; subsequently, when the protruding part 12 is moved to be flush with the annular retaining wall 31, the annular retaining wall 31 is driven to rotate, so that the terminal connecting part 33 is exposed to the outside, and the first conducting terminal 113 can be engaged with the terminal connecting part 33.

Of course, in other example(s) of the present disclosure, it's also possible to allow the first conducting terminal 1131 to be engaged with the terminal connecting part 33 by means of directly pushing the protruding part 12 to be moved towards the releasing position along the longitudinal lengthwise direction D1, which is well-known technique for those ordinary skilled in the art, without particularly described herein.

In an example of the present disclosure, the adaptor 10 further includes an elastic member 14 located between the main body 11 and the protruding part 12. The elastic member 14 can be a spring. The elastic member 14 is configured for providing the protruding part 12 with an acting force when the protruding part 12 is in the releasing position, to move the protruding part 12 towards the blocking position. Due to the presence of the elastic member 14, the protruding part 12 always has a tendency of moving towards the blocking position, so that the protruding part 12 can automatically return to the blocking position when the adaptor 10 is separated from the power supply module 30. Specifically, when the adaptor 10 is engaged with the power supply module 30, the protruding part 12 is subjected to a resisting force from the power supply module 30, and is moved to the releasing position and maintains in the releasing position; the operating component 13 is moved to the on-position to turn on the conducting circuit 113. When the adaptor 10 is separated from the power supply module 30, the elastic member 14 being compressed provides the protruding part 12 with an acting force which moves the protruding part 12 towards the blocking position, so that the protruding part 12 rebounds to the blocking position from the releasing position; during this process, the operating component 13 is driven to move from the on-position to the off-position, so as to turn off the conducting circuit 113.

In an example of the present disclosure, the main body 11 includes an outer wall 114 and an inner chamber 115 enclosed by the outer wall 114; the power supply mounting part 111 and the light source mounting part 112 both are provided on the outer wall 114, and the conducting circuit 113 is received in the inner chamber 115.

The operating component 13 is located on the outer wall 114, and is operatively movable on the outer wall 114. In a practical application, the main body 11 further includes a sliding groove 116 located on the outer wall 114, the operating component 13 is movably located in the sliding groove so as to switch between the on-position and the off-position. Depending on different layout of the sliding groove, the operating component 13 with different motion tracks can be obtained. For example, the sliding groove 116 can extend along the longitudinal lengthwise direction D1 of the main body 11, and then the operating component 13 can also be movable along the direction D1, so that when the adaptor 10 held by the user is engaged with power supply module 30, the operating component 13 can be prodded with a thumb along a curved direction of the thumb, which makes an operation of the operating component 13 more ergonomic, thereby improving the user experience.

Of course, the operating component 13 may not move along the direction D1, for example, the operating component 13 can move on the main body 11 spirally or rotatably;

the operating component 13 even can be a button or the like, without particularly described herein.

In an example of the present disclosure, the operating component 13 includes a pushing part 131 movable in the sliding groove 116 on the outer wall 114, an extension part 132 connected to the pushing part 131, and a locking protrusion 133 located on a surface of the pushing part 131 facing the sliding groove 116; a surface of the pushing part 131 is configured to be rough so that it's convenient for the user to push. An extension direction of the extension part 132 is directing to the inner chamber 115 of the main body 11 from the outer wall 114 of the main body 11.

The sliding groove 116 is provided with a locking recess 1161. During the movement of the operating component 13, the locking protrusion 133 will enter the locking recess 116 so that positions of the operating component 13 and the main body 11 are fixed, i.e., the operating component 13 is locked with the outer wall 114 of the main body 11. In this case, the protruding part 12 is in the releasing position, and the operating component 13 is in an on-state. Subsequently, it only needs to push the locking protrusion 133 of the operating component 13 to leave the locking recess 1161, so that the operating component 13 is unlocked from the outer wall 114 of the main body 11, i.e., allowing the protruding part 12 to be released from the releasing position and moved to the blocking position under the action of the elastic member 14, and meanwhile driving the operating component 13 to move to the off-position.

Figure 7:
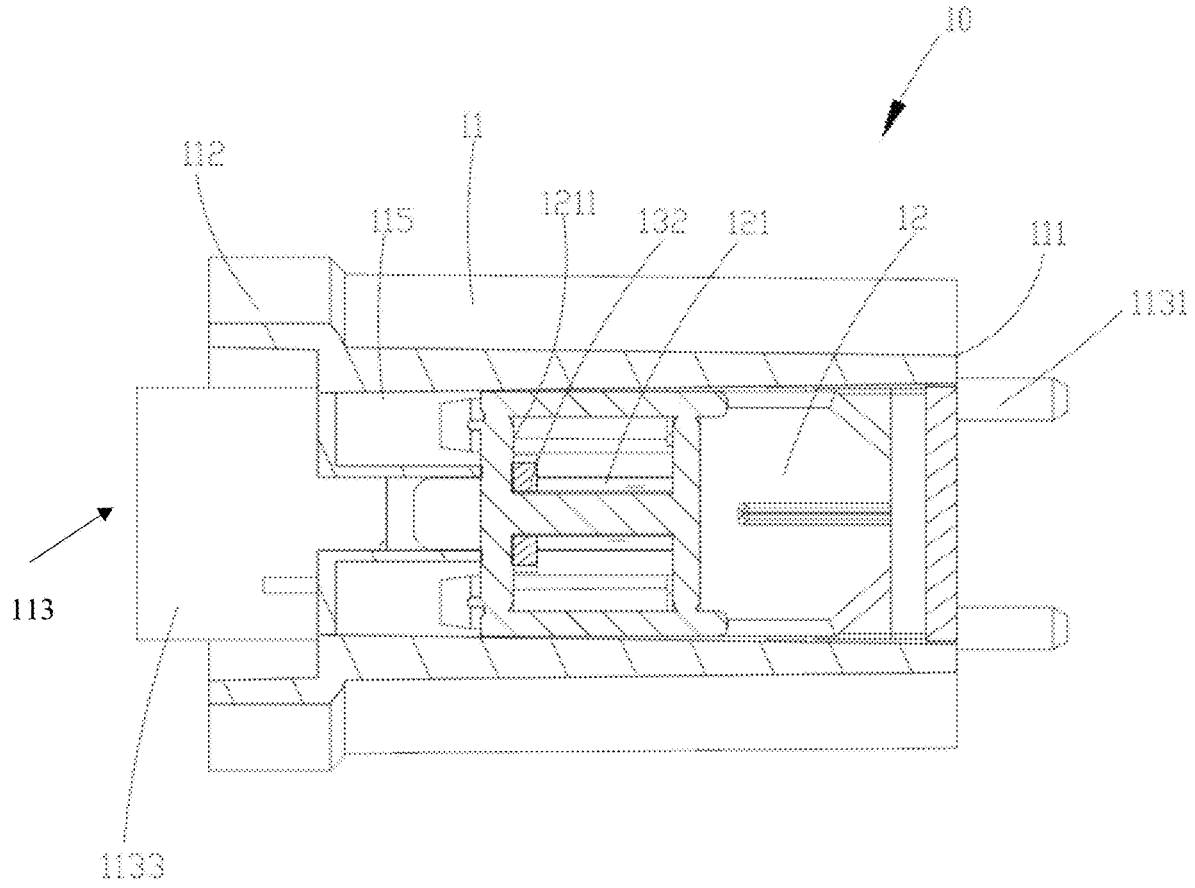
FIG. 7 is a cross-sectional view of an adaptor taken along B-B direction in the lighting apparatus illustrated in FIG. 2.

With reference to FIGS. 6 and 7, the protruding part 12 includes an operating component receiving chamber 121, and the extension part 132 of the operating component 13 extends into the operating component receiving chamber 121. With the movement of the operating component 13, the extension part 132 will be interfered with the retaining wall 1211 at a periphery of the operating component receiving chamber 121.

In an example of the present disclosure, with the movement of the operating component 13 in the sliding groove 116, the operating component 13 can move to the on-position and the off-position. When the locking protrusion 133 of the operating component 13 enters the locking recess 1161 of the sliding groove 116, the operating component 13 is locked with the outer wall 114, and the operating component 13 is in its on-position; in this case, the extension part 132 of the operating component 132 is interfered with the retaining wall 1211 of the protruding 12, and hence to lock the protruding part 12 in the releasing position; when the locking protrusion 133 of the operating component 13 is separated from the locking recess 1161 of the sliding groove 116, the extension part 132 of the operating component 13 no longer can be interfered with the retaining wall 1211 of the protruding part 12, and then the protruding part 12 is released from the releasing position and moved towards the blocking position; subsequently, the operating component 13 is abutted against an edge of the sliding groove 116 through the pushing part 131 thereof, so that the extension part 132 of the operating component 13 is interfered with the retaining wall 1211 of the protruding part 12, again, to limit the protruding part 12 in its blocking position.

When the operating component 13 is in the on-position and the off-position, it cannot only play a role of limiting the position of the protruding part 12 but also can turn on or turn off the conducting circuit 113. Specifically, when the operating component 13 is in the on-position, the operating component 13 turns on the conducting circuit 113; when the operating component 13 is in the off-position, the operating component 13 turns off the conducting circuit 113.

In a practical application, the conducting circuit 113 can be turned on and turned off by the operating component 13 moving to a position above the on-off switch 1134 in the conducting circuit 113 and by the operating component 13 cooperating with the on-off switch 1134. Specifically, by arranging the position of the extension part 132 of the operating component 13 and the position of the on-off switch 1134, when the operating component 13 is in the on-position, the extension part 132 is located above the switch button 11342 of the on-off switch 1134 and press the switch button 11342 towards the switch base 11341 so as to turn on the on-off switch 1134, thereby achieving turning on the conducting circuit 113. Correspondingly, when the operating component 13 moves from the on-position to the off-position, the extension part 132 leaves the position above the switch button 11342, and the switch button 11342 moves far away from the switch base 11341 and returns to its original position, so that the on-off switch 1134 is turned off, thereby achieving turning off the conducting circuit 113.

In a practical application, the adaptor 10 includes an elastic pressing piece 15 movably connected to the main body 11. The elastic pressing piece 15 is located inside the inner chamber 115, and the extension part 132 of the operating component 13 can press against the elastic pressing piece 15 to move the elastic pressing piece 15 towards or away from the switch button 11342 of the on-off switch 1134, so as to turn on and turn off the on-off switch 1134 by pressing the switch button 11342 towards the switch base 11341 and by releasing the switch button 11342.

In a practical application, the elastic pressing piece 15 can include a fixing part 151 connected to the switch base 11341 of the on-off switch 1134, and a cantilever part 152 elastically connected to the fixing part 151; the cantilever part 152 extends to be above the switch button 11342. When the cantilever part 152 is not subjected to an external force, it is suspended above the switch button 11342 without pressing against the switch button 11342; subsequently, with the movement of the operating component 13, the extension part 132 of the operating component 13 presses against the cantilever part 152 and moves the cantilever part 152 towards the switch button 11342, and hence pushes the switch button 11342 towards the switch base 11341, so as to turn on the on-off switch 1134. Subsequently, with the movement of the operating component 13 which releases the cantilever part 152, the cantilever part 152 will return to its original position under an elastic force of the cantilever part 152 itself, and will be suspended above the switch button 11342 again.

By turning on and turning off the on-off switch 1134 through disposing the elastic pressing piece 15, it has no need of precisely setting the position of the extension part 132 of the operating component 13 and the position of the switch button 11342; thus the switch button 11342 still can be pressed and released even if the operating component 13 is in the on-position and the extension part 132 has not moved to the position above the switch button 11342 yet, which reduces a difficulty in manufacturing the adaptor 10.

To sum up, in the adaptor 10, the light source device and the lighting apparatus 100 provided by the examples of the present disclosure, the adaptor 10 is provided with the protruding part 12 and the operating component 13 which are relatively fixed, the protruding part 12 can be moved to the blocking position for blocking the power supply mounting part 111 from being mounted to the power supply module 30 and to the releasing position for releasing the power supply mounting part 111 to be mounted to the power supply module 30; when the adaptor 10 is engaged with the power supply module 30, the protruding part 12 subjected to a resisting force from the power supply module 30 is moved to the releasing position and maintains in the releasing position, and the operating component 13 is moved to the on-position so as to turn on the conducting circuit 113; when the adaptor 10 is separated from the power supply module 30, the protruding part 12 is moved from the releasing position to the blocking position and meanwhile driving the operating component 13 to move from the on-position to the off-position so as to turn off the conducting circuit 113, which prevents the user from activating the lighting apparatus by misoperation and resulting in an electric shock, thereby improving the safety of the lighting apparatus. Furthermore, the lighting apparatus can be quickly assembled and turned on when it demands to use the lighting apparatus.

Alternatively or additionally, the operating component is locked with the outer wall when the operating component is in the on-position; the operating component is unlocked from the outer wall when the operating component is in the off-position.

Alternatively or additionally, the main body has a longitudinal lengthwise direction along which the operating component is operatively movable on the main body.

Alternatively or additionally, the protruding part includes a first portion and a second portion both extending along the longitudinal lengthwise direction of the main body, the first portion and the second portion are perpendicular connected.

Alternatively or additionally, ends of the first portion and the second portion each are provided with a guiding slope.

Alternatively or additionally, the main body includes an outer wall and a sliding groove disposed on the outer wall and extending along the longitudinal lengthwise direction, and the operating component is slidably disposed in the sliding groove.

Alternatively or additionally, the sliding groove includes a locking recess, the operating component includes a locking protrusion; the operating component is capable of operatively driving the locking protrusion to move into the locking recess to limit the operating component in the on-position.

Alternatively or additionally, the adaptor includes an elastic member located between the protruding part and the main body; when the protruding part is in the releasing position, the elastic member provides the protruding part with an acting force to move the protruding part towards the blocking position.

Alternatively or additionally, when the power supply mounting part is separated from the power supply module, the elastic member being compressed provides the protruding part with an acting force which moves the protruding part towards the blocking position, so that the protruding part rebounds to the blocking position from the releasing position and meanwhile driving the operating component to move from the on-position to the off-position.

Alternatively or additionally, the conducting circuit includes an on-off switch, the operating component is cooperated with the on-off switch to turn on and turn off the conducting circuit.

Alternatively or additionally, the adaptor includes an elastic pressing piece movably connected to the main body, the operating component operatively drives the pressing piece to move towards or move away from the on-off switch so as to turn on or turn off the on-off switch.

In order to solve the technical problem above, an example of the present disclosure provides a light source device, including: a light-emitting apparatus; and the adaptor as described in the preceding contents of disclosure, wherein the light source mounting part in the adaptor is engaged with the light-emitting apparatus so that the conducting circuit is electrically connected to the light-emitting apparatus.

Alternatively or additionally, the light-emitting apparatus is a long straight light tube.

Alternatively or additionally, the adaptor and the light-emitting apparatus are integrally provided.

Alternatively or additionally, the light-emitting apparatus is a long straight light tube.

Alternatively or additionally, the light-emitting apparatus and the adaptor are integrally provided, the power supply module and the adaptor are detachably engaged.

As it can be seen from the technical solutions provided by the above examples of the present disclosure, in the adaptor, the light source device and the lighting apparatus provided by the examples of the present disclosure, by arranging the protruding part and the operating component in the adaptor, the protruding part can be moved to the blocking position for blocking the power supply mounting part from being mounted to the power supply module, and moved to the releasing position for releasing the power supply mounting part to be mounted to the power supply module; when the adaptor is engaged with the power supply module, the protruding part subjected to a resisting force from the power supply module is moved to the releasing position and maintains in the releasing position, and the operating component is moved to the on-position so as to turn on the conducting circuit; when the adaptor is separated from the power supply module, the protruding part is moved from the releasing position to the blocking position and meanwhile driving the operating component to move from the on-position to the off-position so as to turn off the conducting circuit, which can prevent the user from activating the lighting apparatus by misoperation and resulting in an electric shock, thereby improving the safety of the lighting apparatus.

The specific examples described above further describe the objectives, technical solutions and beneficial effects of the present disclosure in detail. It should be understood that the above are merely specific examples of the present disclosure and are not intended to limit the present disclosure. Any modification, equivalent replacement, improvement, etc. made within the spirit and principle of the present disclosure should be included in the protection scope of the present disclosure.

The invention claimed is:

1. An adaptor for electrically connecting a power supply module with a light-emitting apparatus, comprising:

a main body, comprising:

an outer wall, forming an inner chamber, a power supply mounting part, located at the outer wall and configured to be engaged with the power supply module;

a light source mounting part, located at the outer wall and disposed opposite to the power supply mounting part, and configured to be engaged with the light-emitting apparatus; and a conducting circuit, located in the inner chamber and configured to be capable of being turned on and off, and configured to transmit electric power outputted by the power supply module to the light-emitting apparatus, when the power supply mounting part is engaged with the power supply module and the light source mounting part is engaged with the light-emitting apparatus, a protruding part, movably connected to the main body, wherein the protruding part is operatively movable to a blocking position and a releasing position; when in the blocking position, the protruding part blocks the power supply mounting part from being engaged with the power supply module, and when in the releasing position, the protruding part releases the power supply mounting part to be engaged with the power supply module, and an operating component, movably connected to the main body and the protruding part, wherein the operating component is operatively movable on the main body to an on-position and an off-position; when the power supply mounting part is engaged with the power supply module, by a resisting force from the power supply module, the protruding part moves to the releasing position and maintains in the releasing position, and the operating component moves to the on-position to turn on the conducting circuit; when the power supply mounting part is separated from the power supply module, the protruding part moves to the blocking position from the releasing position and meanwhile driving the operating component to move from the on-position to the off-position to turn off the conducting circuit.

2. The adaptor according to claim 1, wherein the operating component is locked with the outer wall when the operating component is in the on-position; the operating component is unlocked from the outer wall when the operating component is in the off-position.

3. The adaptor according to claim 1, wherein the main body has a longitudinal lengthwise direction along which the operating component is operatively movable on the main body.

4. The adaptor according to claim 3, wherein the protruding part comprises a first portion and a second portion both extending along the longitudinal lengthwise direction of the main body, the first portion and the second portion are perpendicular connected.

5. The adaptor according to claim 4, wherein ends of the first portion and the second portion each are provided with a guiding slope.

6. The adaptor according to claim 3, wherein the main body comprises the outer wall and a sliding groove disposed on the outer wall and extending along the longitudinal lengthwise direction, the operating component is slidably disposed in the sliding groove.

7. The adaptor according to claim 6, wherein the sliding groove comprises a locking recess, the operating component comprises a locking protrusion, the operating component is capable of operatively driving the locking protrusion to move into the locking recess to limit the operating component in the on-position.

8. The adaptor according to claim 1, wherein the adaptor comprises an elastic member located between the protruding part and the main body, when the protruding part is in the releasing position, the elastic member provides the protruding part with an acting force which moves the protruding part towards the blocking position.

9. The adaptor according to claim 8, wherein when the power supply mounting part is separated from the power supply module, the elastic member being compressed provides the protruding part with an acting force to move the protruding part towards the blocking position, so that the protruding part rebounds to the blocking position from the releasing position and meanwhile driving the operating component to move from the on-position to the off-position.

10. The adaptor according to claim 1, wherein the conducting circuit comprises an on-off switch, the operating component is cooperated with the on-off switch to turn on and turn off the conducting circuit.

11. The adaptor according to claim 10, wherein the adaptor comprises an elastic pressing piece movably connected to the main body, the operating component operatively drives the pressing piece to move towards or move away from the on-off switch so as to turn on or turn off the on-off switch.

12. A light source device, comprising:

a light-emitting apparatus; and an adaptor for electrically connecting a power supply module with the light-emitting apparatus, the adapter comprising: a main body that comprises:

an outer wall, forming an inner chamber, a power supply mounting part, located at the outer wall and configured to be engaged with the power supply module;

a light source mounting part, located at the outer wall and disposed opposite to the power supply mounting part, and configured to be engaged with the light-emitting apparatus; and a conducting circuit, located in the inner chamber and configured to be capable of being turned on and off, and configured to transmit electric power outputted by the power supply module to the light-emitting apparatus, when the power supply mounting part is engaged with the power supply module and the light source mounting part is engaged with the light-emitting apparatus, a protruding part, movably connected to the main body, wherein the protruding part is operatively movable to a blocking position and a releasing position; when in the blocking position, the protruding part blocks the power supply mounting part from being engaged with the power supply module, and when in the releasing position, the protruding part releases the power supply mounting part to be engaged with the power supply module, and an operating component, movably connected to the main body and the protruding part, wherein the operating component is operatively movable on the main body to an on-position and an off-position; when the power supply mounting part is engaged with the power supply module, by a resisting force from the power supply module, the protruding part moves to the releasing position and maintains in the releasing position, and the operating component moves to the on-position to turn on the conducting circuit; when the power supply mounting part is separated from the power supply module, the protruding part moves to the blocking position from the releasing position and meanwhile driving the operating component to move from the on-position to the off-position to turn off the conducting circuit, wherein the light source mounting part in the adaptor is engaged with the light-emitting apparatus so that the conducting circuit is electrically connected to the light-emitting apparatus.

13. The light source device according to claim 12, wherein the light-emitting apparatus is a long straight light tube.

14. The light source device according to claim 12, wherein the adaptor and the light-emitting apparatus are integrally provided.

15. A lighting apparatus, comprising:

a light-emitting apparatus;

a power supply module; and an adaptor for electrically connecting the power supply module with the light-emitting apparatus, the adapter comprising: a main body that comprises:

an outer wall, forming an inner chamber, a power supply mounting part, located at the outer wall and configured to be engaged with the power supply module;

a light source mounting part, located at the outer wall and disposed opposite to the power supply mounting part, and configured to be engaged with the light-emitting apparatus; and a conducting circuit, located in the inner chamber and configured to be capable of being turned on and off, and configured to transmit electric power outputted by the power supply module to the light-emitting apparatus, when the power supply mounting part is engaged with the power supply module and the light source mounting part is engaged with the light-emitting apparatus, a protruding part, movably connected to the main body, wherein the protruding part is operatively movable to a blocking position and a releasing position; when in the blocking position, the protruding part blocks the power supply mounting part from being engaged with the power supply module, and when in the releasing position, the protruding part releases the power supply mounting part to be engaged with the power supply module, and an operating component, movably connected to the main body and the protruding part, wherein the operating component is operatively movable on the main body to an on-position and an off-position; when the power supply mounting part is engaged with the power supply module, by a resisting force from the power supply module, the protruding part moves to the releasing position and maintains in the releasing position, and the operating component moves to the on-position to turn on the conducting circuit; when the power supply mounting part is separated from the power supply module, the protruding part moves to the blocking position from the releasing position and meanwhile driving the operating component to move from the on-position to the off-position to turn off the conducting circuit, wherein the light source mounting part in the adaptor is engaged with the light-emitting apparatus, and the power supply mounting part in the adaptor is engaged with the power supply module, so that both of the light-emitting apparatus and the power supply module are electrically connected to the conducting circuit.

16. The lighting apparatus according to claim 15, wherein the light-emitting apparatus is a long straight light tube.

17. The lighting apparatus according to claim 15, wherein the light-emitting apparatus and the adaptor are integrally provided, the power supply module and the adaptor are detachably engaged.

* * * * *